US010518998B2

(12) United States Patent
Watanabe

(10) Patent No.: US 10,518,998 B2
(45) Date of Patent: Dec. 31, 2019

(54) SHEET PROCESSING APPARATUS

(71) Applicant: CANON KABUSHIKI KAISHA, Tokyo (JP)

(72) Inventor: Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 15/642,446

(22) Filed: Jul. 6, 2017

(65) Prior Publication Data

US 2018/0016111 A1 Jan. 18, 2018

(30) Foreign Application Priority Data

Jul. 13, 2016 (JP) ..... 2016-138215

(51) Int. Cl.

| | |
|---|---|
| ***B65H 37/06*** | (2006.01) |
| ***B65H 45/30*** | (2006.01) |
| ***B42C 19/02*** | (2006.01) |
| ***G03G 15/00*** | (2006.01) |
| ***B65H 43/00*** | (2006.01) |
| ***B65H 37/04*** | (2006.01) |
| ***B65H 45/16*** | (2006.01) |
| ***B65H 45/18*** | (2006.01) |

(52) U.S. Cl.

CPC ..... *B65H 43/00* (2013.01); *B42C 19/02* (2013.01); *B65H 37/04* (2013.01); *B65H 37/06* (2013.01); *B65H 45/162* (2013.01); *B65H 45/18* (2013.01); *B65H 45/30* (2013.01); *G03G 15/6544* (2013.01); *B65H 2301/31122* (2013.01); *B65H 2301/4213* (2013.01); *B65H 2301/51232* (2013.01); *B65H 2301/51611* (2013.01); *B65H 2511/152* (2013.01); *B65H 2511/30* (2013.01); *B65H 2515/112* (2013.01); *B65H 2701/18264* (2013.01); *B65H 2801/24* (2013.01); *B65H 2801/27* (2013.01); *G03G 2215/00877* (2013.01)

(58) Field of Classification Search

CPC ..... B65H 45/30; B65H 2515/112

See application file for complete search history.

(56) References Cited

U.S. PATENT DOCUMENTS

| | | | | |
|---|---|---|---|---|
| 7,635,120 | B2 * | 12/2009 | Awano | B42C 5/00 270/37 |
| 7,866,645 | B2 | 1/2011 | Fujita et al. | |
| 8,226,078 | B2 | 7/2012 | Watanabe et al. | |
| 8,231,120 | B2 | 7/2012 | Hayashi et al. | |
| 8,302,951 | B2 | 11/2012 | Watanabe et al. | |

(Continued)

FOREIGN PATENT DOCUMENTS

| | | |
|---|---|---|
| JP | 2007-144679 A | 6/2007 |
| JP | 2011-057363 A | 3/2011 |

(Continued)

*Primary Examiner* — Jennifer E Simmons

(74) *Attorney, Agent, or Firm* — Venable LLP

(57) ABSTRACT

A sheet processing apparatus comprising: a scoring unit which scores a sheet; a folding unit which folds a sheet bundle including a plurality of sheets; a pressing unit which presses a folded part of the sheet bundle folded by the folding unit; and a controller which determines, based on information on the sheet bundle, whether the scoring unit scores the sheet included in the sheet bundle to be folded and whether the pressing unit presses the folded part of the sheet bundle.

13 Claims, 17 Drawing Sheets

(56) References Cited

U.S. PATENT DOCUMENTS

| | | | | |
|---|---|---|---|---|
| 8,322,701 | B2 | 12/2012 | Hattori et al. | |
| 9,227,807 | B2 | 1/2016 | Watanabe | |
| 2008/0101836 | A1 | 5/2008 | Fujita et al. | |
| 2013/0127106 | A1* | 5/2013 | Motoyoshi | B65H 39/00 270/45 |
| 2015/0314626 | A1 | 11/2015 | Kushida et al. | |
| 2016/0031671 | A1* | 2/2016 | Kato | B65H 43/00 493/399 |

FOREIGN PATENT DOCUMENTS

| | | | |
|---|---|---|---|
| JP | 2011-093708 | A | 5/2011 |
| JP | 2012-071979 | A | 4/2012 |
| JP | 2012-101923 | A | 5/2012 |

* cited by examiner

FIG. 15

| BASIS WEIGHT OF OUTERMOST SHEET | | NUMBER OF INNER SHEETS | | | | NECESSITY OF SCORING | NECESSITY OF ADDITIONAL FOLDING |
|---|---|---|---|---|---|---|---|
| -157gsm | 157gsm - | 0 SHEET | 1 SHEET | 2-9 SHEETS | 10 SHEETS | | |
| Y | N | Y | N | N | N | N | N |
| Y | N | N | Y | N | N | N | N |
| Y | N | N | N | Y | N | N | Y |
| Y | N | N | N | N | Y | N | Y |
| N | Y | Y | N | N | N | Y | N |
| N | Y | N | Y | N | N | Y | N |
| N | Y | N | N | Y | N | Y | N |
| N | Y | N | N | N | Y | N | Y |

*FIG. 16*

| BASIS WEIGHT OF OUTERMOST SHEET | | NUMBER OF INNER SHEETS | BASIS WEIGHT OF INNER SHEET | NECESSITY OF SCORING | NECESSITY OF ADDITIONAL FOLDING |
|---|---|---|---|---|---|
| -157gsm | 157gsm - | | | | |
| Ga | - | N | H | N | $Y = 1xGa+NxH \geqq 1050$ |
| - | Gb | N | H | $Y = 1xGb+NxH < 1050$ | $Y = 1xGb+NxH \geqq 1050$ |

SHEET PROCESSING APPARATUS

BACKGROUND OF THE INVENTION

Field of the Invention

The present invention relates to a sheet processing apparatus which creates a booklet by saddle-binding and half-folding a sheet bundle including a plurality of sheets.

Description of the Related Art

Conventionally, there is known a sheet processing apparatus which creates a booklet by binding a sheet bundle by a saddle-binding processing unit, and performing a folding process by a folding processing unit. The booklet created in this manner has a problem that a crack occurs at the folded part of the outer sheet when the sheet bundle is thin, and the created booklet opens when the sheet bundle is thick.

The crack occurring at the folded part is a phenomenon in which the folded part of the outer sheet cracks because the elongation amount of the outer sheet of the sheet bundle becomes larger than the elongation amount of the inner sheet when the folding process is performed. This phenomenon easily occurs when the sheet being used is thick, and the crack occurring at the folded part of the outermost sheet of a booklet deteriorates the appearance. In order to prevent this, there is known a sheet scoring apparatus which prevents occurrence of a crack at a folded part by scoring a sheet at the folded part in advance as disclosed in Japanese Patent Laid-Open No. 2011-57363.

In addition, the reason that a booklet opens is that a sheet bundle is thick and folding is not enough. In order to prevent this, there is known an additional folding unit called a square fold which flatly crushes a folded part as disclosed in Japanese Patent Laid-Open No. 2007-144679.

However, scoring is not effective in every booklet. The scoring in which a sheet bundle is firmly folded is effective in a thin sheet bundle. However, folding to a thick sheet bundle in which cracks hardly occur at the folded part is not enough and the scoring merely produces a booklet having a score at the folded part. Although the thick booklet is subjected to square fold to be strongly folded by flattening the folded part, the booklet having a score on the flattened spine is created. For this reason, it is necessary to perform a troublesome work for operator to create a booklet to determine whether scoring a sheet bundle is necessary.

SUMMARY OF THE INVENTION

A sheet processing apparatus according to an embodiment of the present invention includes: a sheet processing apparatus comprising: a scoring unit which scores a sheet; a folding unit which folds a sheet bundle including a plurality of sheets; a pressing unit which presses a folded part of the sheet bundle folded by the folding unit; and a controller which determines, based on information on the sheet bundle, whether the scoring unit scores the sheet included in the sheet bundle to be folded and whether the pressing unit presses the folded part of the sheet bundle.

According to an embodiment of the present invention, it is possible for a sheet processing apparatus to create a sheet bundle under appropriate creating conditions according to a sheet bundle to be created.

Further features of the present invention will become apparent from the following description of exemplary embodiments with reference to the attached drawings.

BRIEF DESCRIPTION OF THE DRAWINGS

FIG. 15 is a determination table for scoring and additional folding processes;

FIG. 16 is a table showing arithmetic expressions for determination of scoring and additional folding processes.

DESCRIPTION OF THE EMBODIMENTS

Suitable embodiments of the present invention will be described in detail below with reference to the accompanying drawings. Note that, the dimensions, materials, shapes, relative positions thereof, and the like of the components described in the following embodiments should be appropriately changed according to the configuration of an apparatus to which the present invention is applied, and various conditions. Therefore, the scope of the present invention is not limited to them unless otherwise specified.

<Image Forming Apparatus>

Figure 1:
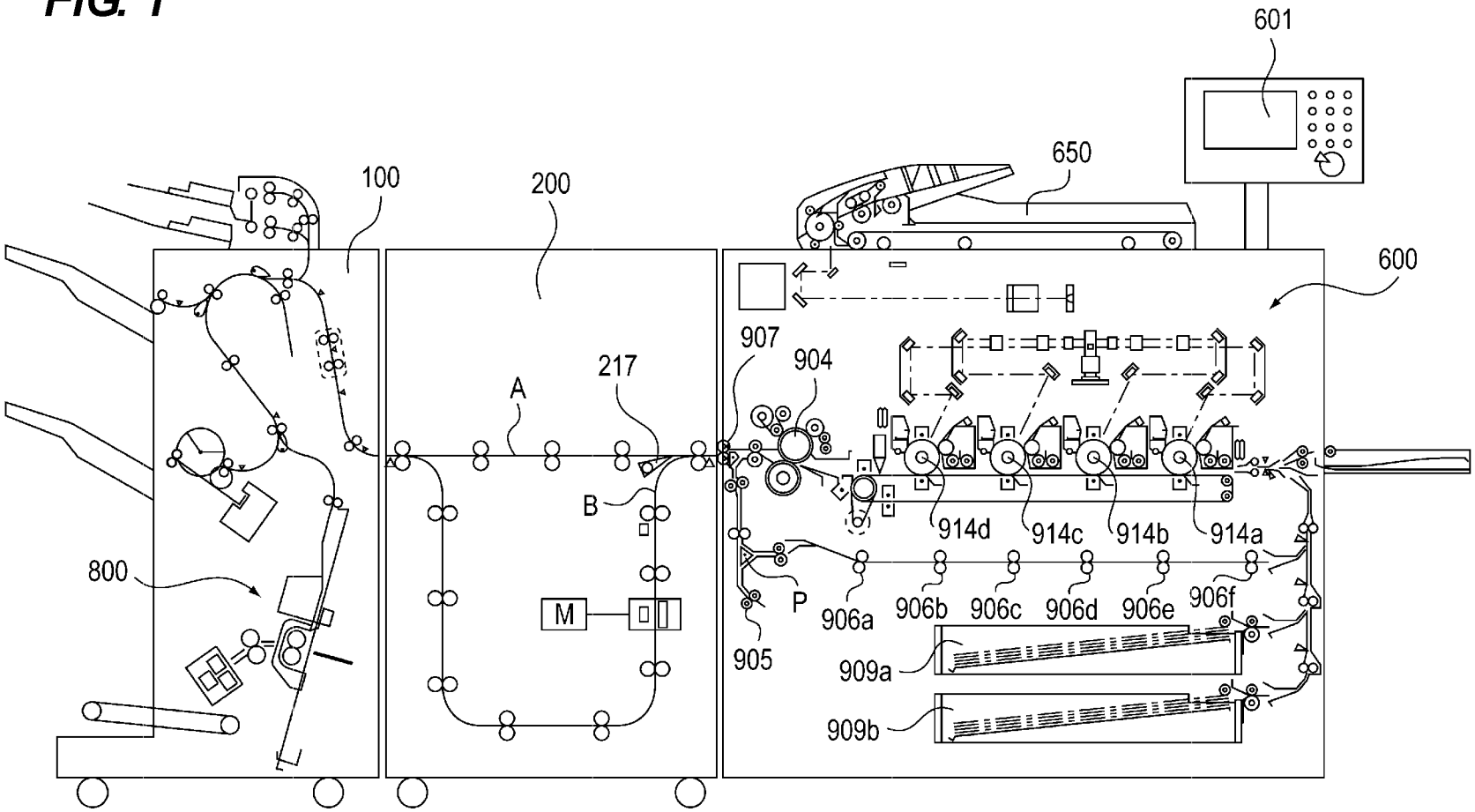
FIG. 1 is a sectional view showing an image forming apparatus including a scoring apparatus.

FIG. 1 is a configuration diagram of an image forming apparatus and a sheet processing apparatus. As shown in FIG. 1, the image forming apparatus includes an image forming apparatus main body 600 which forms a monochrome/color image, a scoring apparatus 200 and a finisher 100 as the sheet processing apparatus connected thereto. Therefore, a sheet discharged from the image forming apparatus main body 600 can be processed by the scoring apparatus 200 and the finisher 100 as the sheet processing apparatus connected online. Note that, the image forming apparatus main body 600 can be used independently without connecting the finisher 100 to the discharge port. Furthermore, the image forming apparatus main body 600 may integrally incorporate the scoring apparatus 200 and the finisher 100 as a sheet discharging device. Here, the position facing an operation portion 601 at which a user performs various input/setting to the image forming apparatus main body 600 is referred to as a front side of the image forming apparatus (hereinafter referred to as a front side), and the rear side of the apparatus is referred to as a back side. FIG. 1 shows the configuration of the image forming apparatus as viewed from the front side of the apparatus. The scoring apparatus 200 and the finisher 100 are connected to a side of the image forming apparatus main body 600.

A cassette 909*a* or 909*b* in the image forming apparatus main body 600 supplies a sheet S, and toner images of four colors are transferred on the sheet S by yellow, magenta, cyan, and black photosensitive drums 914*a* to 914*d* and the like constituting an image forming portion. Then, the sheet S is conveyed to a fixing unit 904 to fix the toner images. In a one-side image forming mode, the sheet S is directly discharged from a pair of discharge rollers 907 to the outside of the apparatus main body. In a both-side image forming mode, the sheet S is delivered from the fixing unit 904 to a reversing roller 905. When the rear end of the sheet in the sheet conveying direction passes over a reversing switching portion P, the reversing roller 905 is reversely rotated, and the sheet S is conveyed in the direction of both-side conveying rollers 906*a* to 906*f* which is the direction opposite to the conveying direction. Then, toner images of the four colors are again transferred on the other side of the sheet by the yellow, magenta, cyan, and black photosensitive drums 914*a* to 914*d*. The sheet S having both sides on which the toner images are transferred is conveyed to the fixing unit 904 again to fix the toner images and is discharged from the pair of discharge rollers 907 to the outside of the apparatus main body.

Figure 2:
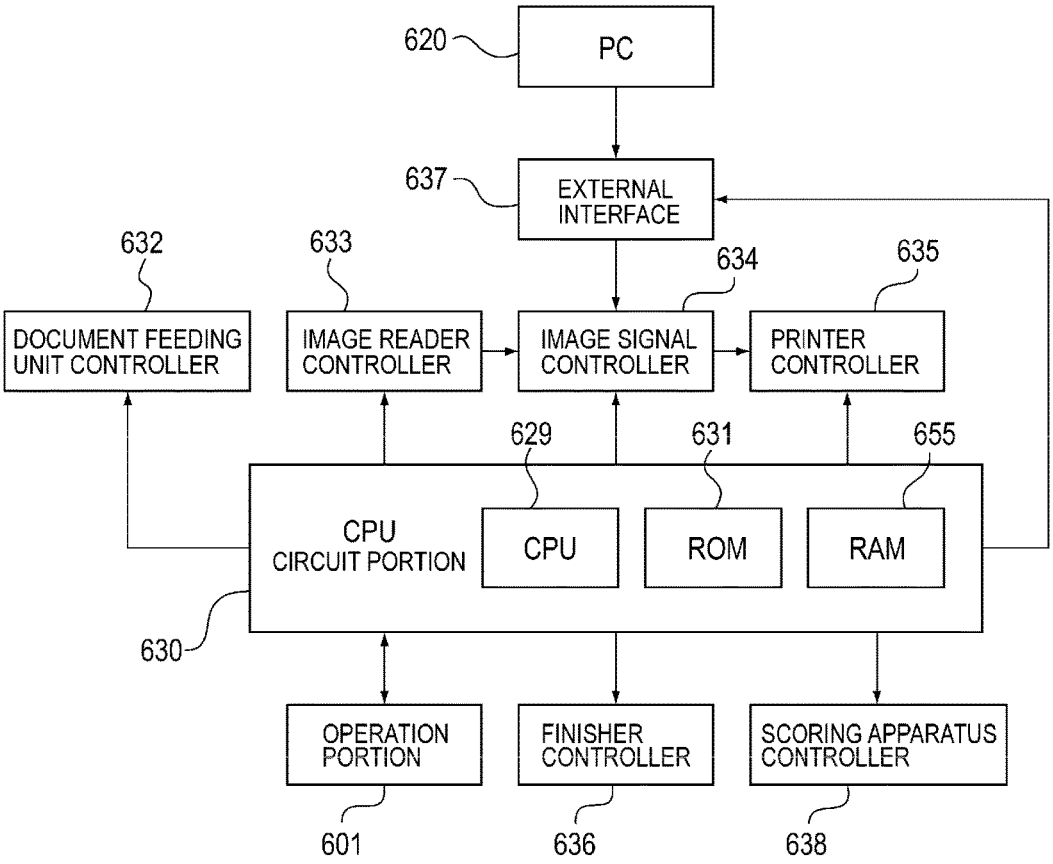
FIG. 2 is a system block diagram of the image forming apparatus.

FIG. 2 is a block diagram of an image forming apparatus controlling portion which controls the image forming apparatus. As shown in FIG. 2, a CPU circuit portion 630 has a CPU 629, a ROM 631, and a RAM 655. The CPU circuit portion 630 controls a document feeding unit controlling portion 632, an image reader controlling portion 633, an image signal controlling portion 634, a printer controlling portion 635, a finisher controlling portion 636, a scoring apparatus controlling portion (controller) 638, and an external interface 637. The CPU circuit portion 630 performs the control according to the program stored in the ROM 631 and the settings of the operation portion 601. The document feeding unit controlling portion 632 controls a document feeding unit 650. The image reader controlling portion 633 controls an image reader. The printer controlling portion 635 controls the image forming apparatus main body 600. The scoring apparatus controlling portion (controller) 638 controls the scoring apparatus 200. The finisher controlling portion 636 controls the finisher 100. In the present embodiment, a configuration in which the scoring apparatus controlling portion (controller) 638 is equipped in the scoring apparatus 200 and the finisher controlling portion (controller) 636 is equipped in the finisher 100 is described. However, the present invention is not limited to the configuration, and the scoring apparatus controlling portion (controller) 638 and the finisher controlling portion (controller) 636 may be provided in the image forming apparatus main body 600 integrally with the CPU circuit portion (controller) 630, and the scoring apparatus 200 and the finisher 100 may be controlled from the image forming apparatus main body 600. Alternatively, the finisher 100 may be controlled by a controller in the scoring apparatus 200, or the scoring apparatus 200 may be controlled by a controller in the finisher 100.

The RAM 655 is used as an area for temporarily holding control data and as a work area for computation accompanying control. The external interface 637 is an interface of a computer (PC) 620, develops print data into an image, and outputs it to the image signal controlling portion 634. The image reader controlling portion 633 outputs an image read by an image sensor to the image signal controlling portion 634, and the image output from the image signal controlling portion 634 to the printer controlling portion 635 is input to an exposure controlling portion.

The scoring apparatus controlling portion 638 is equipped in the scoring apparatus 200 and performs drive control of the entire scoring apparatus by exchanging information with the CPU circuit portion 630 of the image forming apparatus. The finisher controlling portion 636 is equipped in the finisher 100 and performs drive control of the entire finisher by exchanging information with the CPU circuit portion 630 of the image forming apparatus. The scoring apparatus controlling portion 638 and the finisher controlling portion 636 control various motors and sensors.

<Scoring Apparatus>

Figure 3:
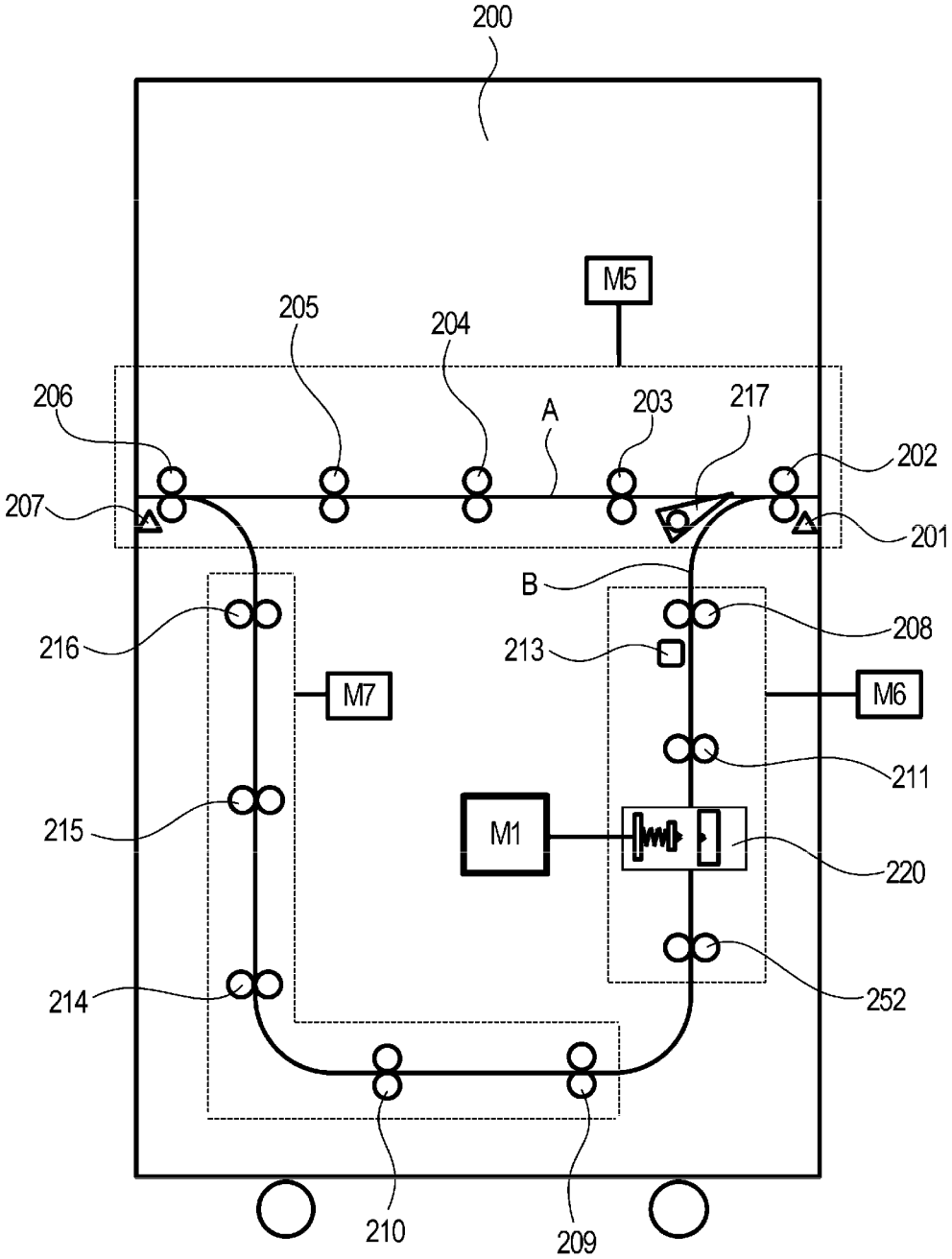
FIG. 3 is a sectional view showing the scoring apparatus.

FIG. 3 is a sectional view of the scoring apparatus 200. As shown in FIG. 3, the scoring apparatus 200 includes a scoring path B which sequentially takes in a sheet discharged from the image forming apparatus main body 600 and performs a scoring process to the taken sheet, and a bypass A which delivers the sheet to the downstream finisher 100 without the process. These paths are switched by a switching member 217.

A sheet process in the scoring apparatus 200 is performed according to the settings made by the user through the operation portion 601 provided on the image forming apparatus main body 600.

The sheet discharged from the image forming apparatus main body 600 is transferred to a pair of inlet rollers 202 of the scoring apparatus 200. At this time, the sheet delivery timing is also detected simultaneously by an inlet sensor 201.

When the scoring process is not performed to the sheet, the path is switched to the bypass A by the switching member 217, and the sheet is conveyed by pairs of conveying rollers 203, 204, and 205 and a pair of discharge rollers 206, and delivered to the downstream finisher 100.

When the scoring process is performed to the sheet, the path is switched to the scoring path B by the switching member 217, the sheet is conveyed to the processing portion by pairs of conveying rollers 208, 211, and 252, and a sheet edge detecting sensor 213 detects the edge of the sheet. After the sheet is stopped at a predetermined position in the conveying direction, a scoring unit (scoring portion) 220 operates to score the sheet. The scored sheet is conveyed again by pairs of conveying rollers 209, 210, 214, 215, and 216, and the pair of discharge rollers 206, and delivered to the downstream finisher 100.

Figure 5:
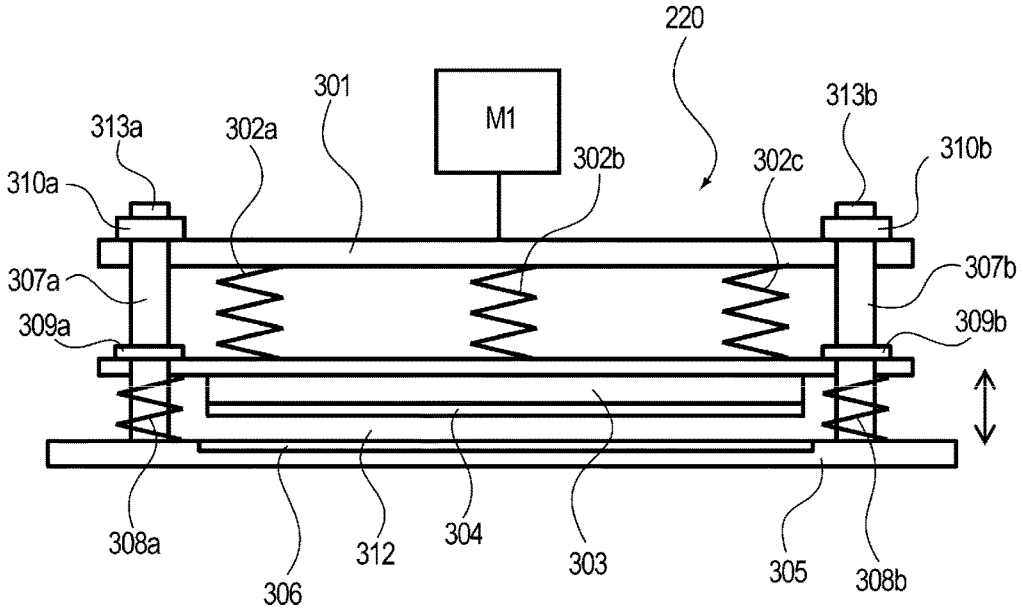
FIG. 5 is a diagram showing a scoring unit.
Figure 6:
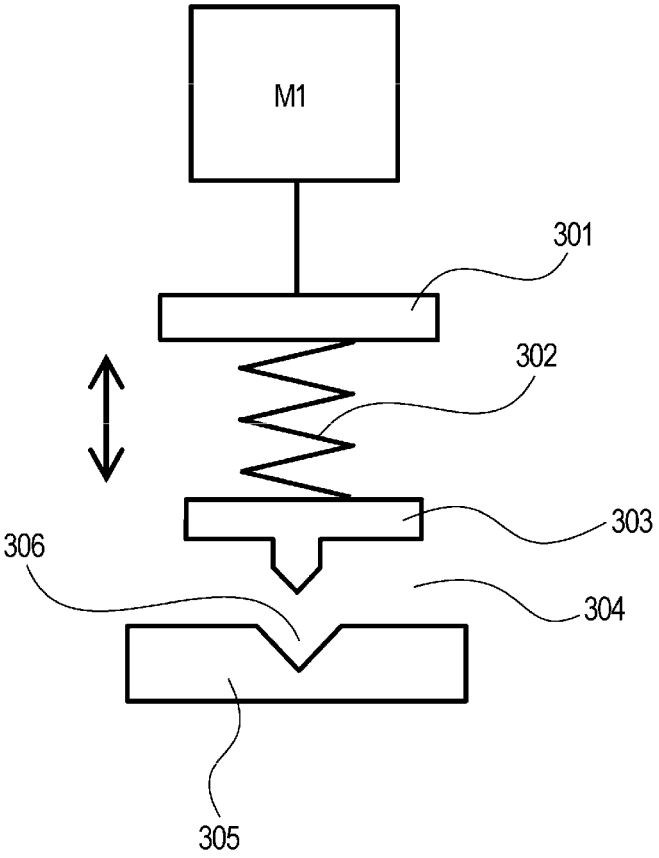
FIG. 6 is a diagram showing the scoring unit.
Figure 7:
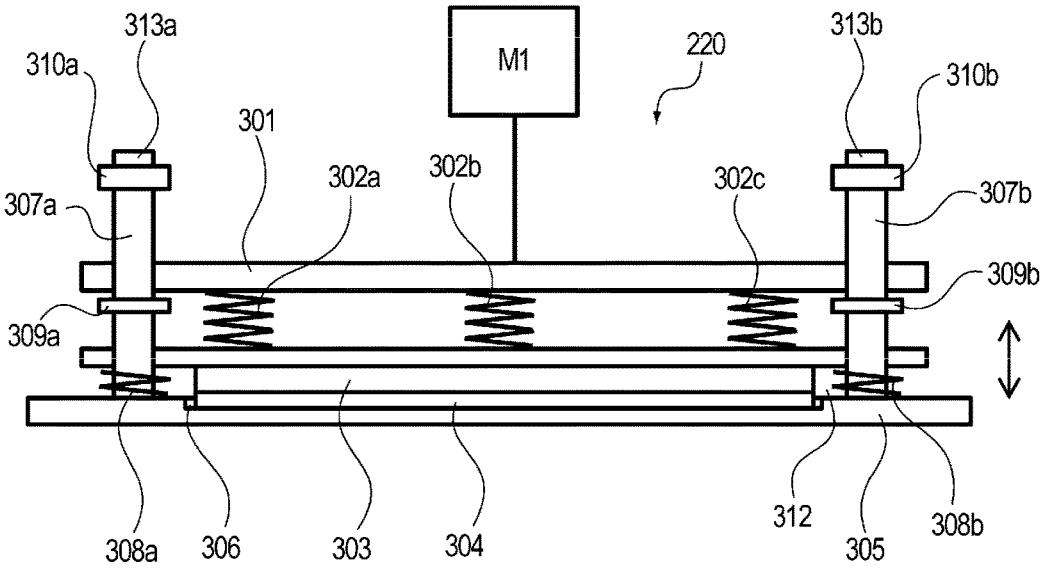
FIG. 7 is a diagram showing the scoring unit.
Figure 8:
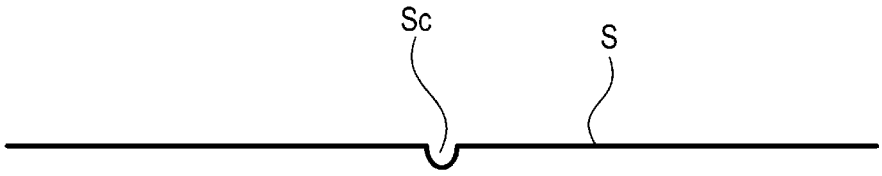
FIG. 8 is a sectional view showing a sheet scored by the scoring unit.

FIG. 5 is a sectional view of the scoring unit (scoring portion) 220 as viewed from the downstream in the sheet conveying direction. FIG. 6 is a view of the scoring unit (scoring portion) 220 as viewed from the front of the apparatus. A die plate 305 has a scoring groove 306. Shaft guides 307*a* and 307*b* stand on the die plate 305 and slidably support a movable plate 301 and a blade holder 303. A scoring blade 304 is disposed on the blade holder 303 and engaged with the scoring groove 306 to score the sheet. The scored sheet is shown in FIG. 8. In FIG. 8, S is a sheet, and Sc is a score on the sheet. Pressing springs 302*a*, 302*b*, and 302*c* are disposed between the movable plate 301 and the blade holder 303. By pressing down the movable plate 301 by a drive motor M1 as shown in FIG. 7, the pressing springs 302*a*, 302*b*, and 302*c* press down the blade holder 303, and the scoring blade 304 is engaged with the scoring groove 306. Releasing springs 308*a* and 308*b* press up the pressed-down blade holder 303. The position of the top dead center of the blade holder 303 abuts stoppers 309*a* and 309*b*, and the position of the top dead center of the movable plate 301 abuts stoppers 310*a* and 310*b*. When the scoring blade 304 is engaged with the scoring groove 306, the force is equally applied to the whole region in the sheet width direction.

Figure 4:
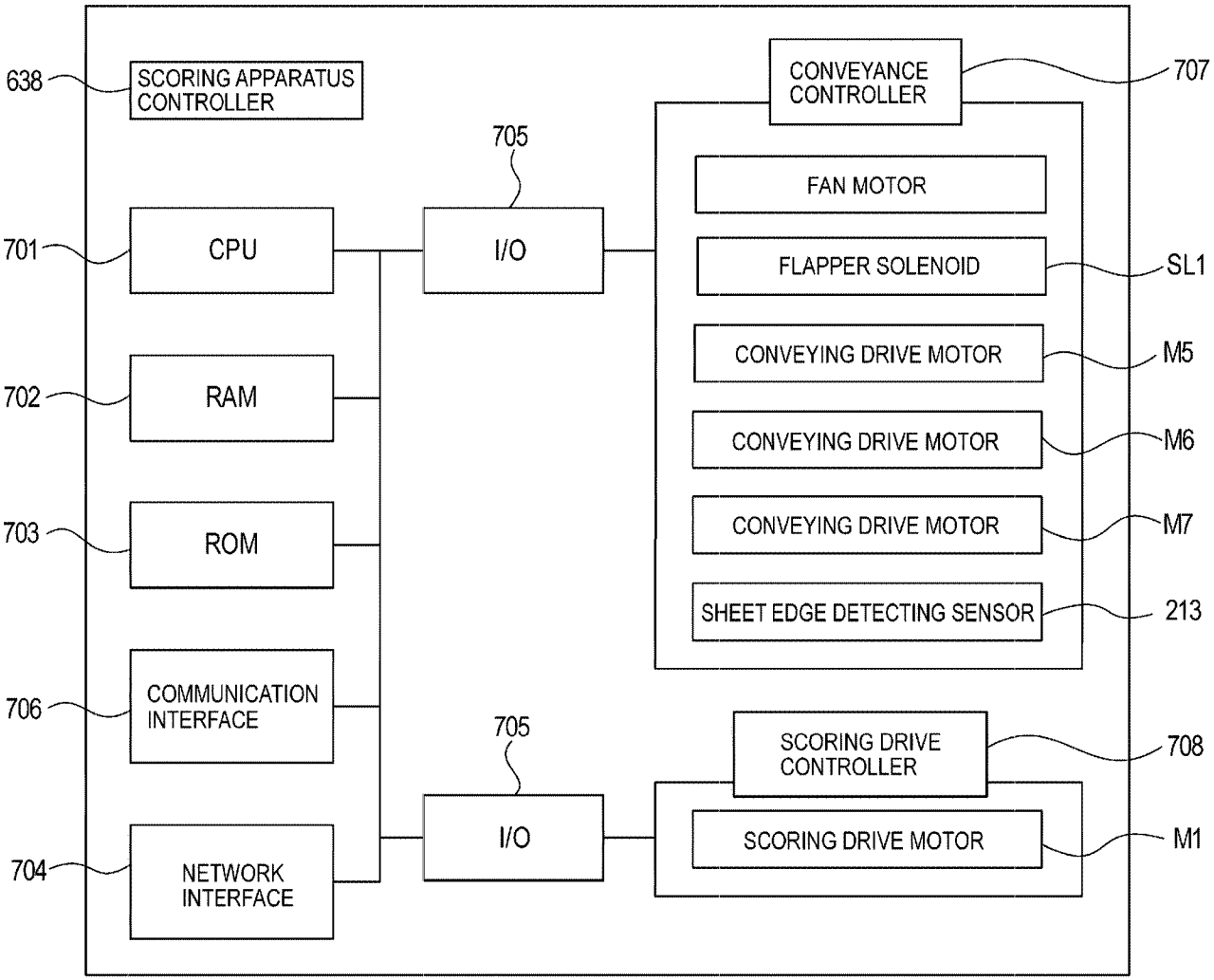
FIG. 4 is a block diagram of the scoring apparatus.

As shown in FIG. 4, the scoring apparatus controlling portion 638 includes a microcomputer (CPU) 701, a RAM 702, a ROM 703, an input/output portion (I/O) 705, a communication interface 706, and a network interface 704.

A conveyance controlling portion 707 controls a solenoid SL1 which drives the switching member 217, conveying motors M5, M6, and M7, the sheet edge detecting sensor 213, and a fan motor which drives a fan. A scoring drive controlling portion 708 controls the scoring drive motor M1. Various sensor signals are input to the input port of the I/O 705. The output port of the I/O 705 is connected to drive systems connected through a control block (not shown) or various drivers (not shown).

<Description of Finisher>

The finisher 100 takes in a sheet conveyed from the image forming apparatus main body 600 through the scoring apparatus 200, and performs a process to the taken sheet. For example, the finisher 100 performs a sheet process, such as a process of aligning a plurality of taken sheets and bundling it as one sheet bundle, a stapling process (binding process) of stapling the rear end side of the sheet bundle, a sorting process, a non-sorting process, or a saddle binding process of creating a booklet.

Figure 9:
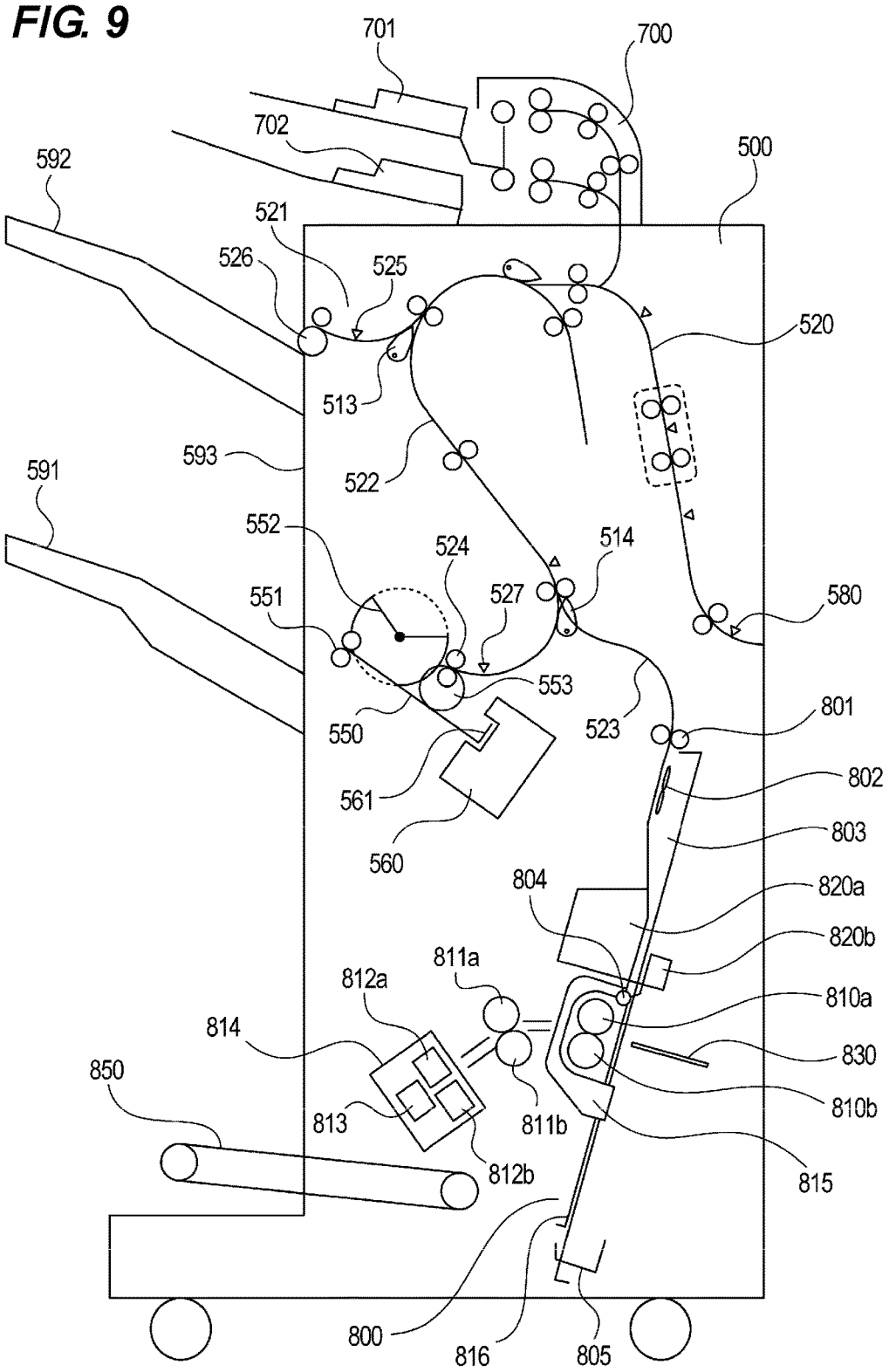
FIG. 9 is a sectional view showing a finisher

As shown in FIG. 9, the finisher 100 includes a conveying path 520 for taking a sheet conveyed through the scoring apparatus 200 into the apparatus, and the conveying path 520 includes a plurality of pairs of conveying rollers.

A switching member 513 provided at the end of the conveying path 520 switches the path to an upper discharging path 521 or a lower discharging path 522 connected to the downstream side. The upper discharging path 521 discharges the sheet to an upper stack tray 592. On the other hand, the lower discharging path 522 discharges the sheet to a processing tray 550. The sheets discharged onto the processing tray 550 are stored in a bundle by sequentially performing conveyance direction alignment in which the rear end of the sheet is butted to a rear end reference wall 561 by a return paddle 552 and a return belt 553, and width direction alignment by an aligning plate (not shown). The sheets stored in a bundle (sheet bundle) are subjected to a sorting process or a stapling process according to the settings from the operation portion 1, and then discharged to stack trays 591 and 592 by a pair of bundle discharge rollers 551.

The stapling process is performed by a stapler 560, and the stapler 560 is movable in the width direction orthogonal to the conveying direction, and can staple the sheets at an arbitrary position thereof. The stack trays 591 and 592 are configured to be movable in the vertical direction. The upper stack tray 592 receives the sheets from the upper discharging path 521 and the processing tray 550, and the lower stack tray 591 receives the sheets from the processing tray 550. In this manner, a large number of sheets can be stacked on the stack trays 591 and 592, and the stacked sheets are aligned by regulating the rear end thereof by a rear end guide 593 extending in the vertical direction.

Next, a configuration of a saddle bookbinding portion 800 in the finisher 100 will be described. The sheet the path of which is switched to the right side by a switching member 514 provided in the middle of the lower discharging path 522 passes through a saddle discharging path 523 and is conveyed to the saddle bookbinding portion 800. The sheet is delivered to a pair of saddle inlet rollers 801, the conveyance entrance is selected by a switching member 802 operated by a solenoid according to the size, and the sheet is conveyed into a storage guide 803 of the saddle bookbinding portion 800. The conveyed sheet is further conveyed by a sliding roller 804 until the leading end of the sheet abuts a movable sheet positioning member 805. The pair of saddle inlet rollers 801 and the sliding roller 804 are driven by a motor M21 (see FIG. 11). A stapler 820 disposed facing itself by interposing the storage guide 803 is provided in the middle of the storage guide 803. The stapler 820 functions as a saddle binding unit which saddle-binds a sheet bundle including a plurality of sheets. The stapler 820 is divided into a driver 820*a* which protrudes needles and an anvil 820*b* which bends the protruded needles. Note that, the sheet positioning member 805 stops at a position where the center part of the sheets in the sheet conveying direction reaches the binding position of the stapler 820 when the sheets are taken in. The sheet positioning member 805 is movable by driving a motor M22 (see FIG. 11), and changes the position according to the sheet size.

A pair of folding rollers 810*a* and 810*b* constituting a folding portion is provided on the downstream side of the stapler 820, and a protruding member 830 is provided at a position facing the pair of folding rollers 810*a* and 810*b*. The protruding member 830 is set to a position retracted from the storage guide 803 as a home position. The protruding member 830 is protruded toward the stored sheet bundle by driving a motor M23 (see FIG. 11), and thereby folds the sheet bundle while pushing the sheet bundle into the nip of the pair of folding rollers 810*a* and 810*b*. The protruding member 830 then returns to the home position again. Between the pair of folding rollers 810*a* and 810*b*, pressure F1 sufficient for creasing the bundle is applied by springs (not shown). The pair of folding rollers 810*a* and 810*b*, and the protruding member 830 constitute the folding portion which folds a sheet bundle in half.

The creased sheet bundle is discharged to a folded-bundle discharge tray 850 through a pair of first folding conveying rollers 811*a* and 811*b*, and a pair of second folding conveying rollers 812*a* and 812*b* constituting an additional folding portion (folded-part processing unit) 814. Pressure F2 and F3 sufficient for conveying and stopping the creased sheet bundle is also applied to the pair of first folding conveying rollers 811 and the pair of second folding conveying rollers (a pair of pressure rollers) 812. When the sheets are conveyed in the storage guide 803, a shutter 816 moves to a position where the leading end of the sheets does not abut the pair of folding rollers 810. When the sheet bundle is protruded by the protruding member 830, the shutter 816 moves in the direction parallel to the storage guide 803 to a position to make a path toward the pair of folding rollers 810. This movement operation is performed by driving a motor M26 (see FIG. 11).

Figure 11:
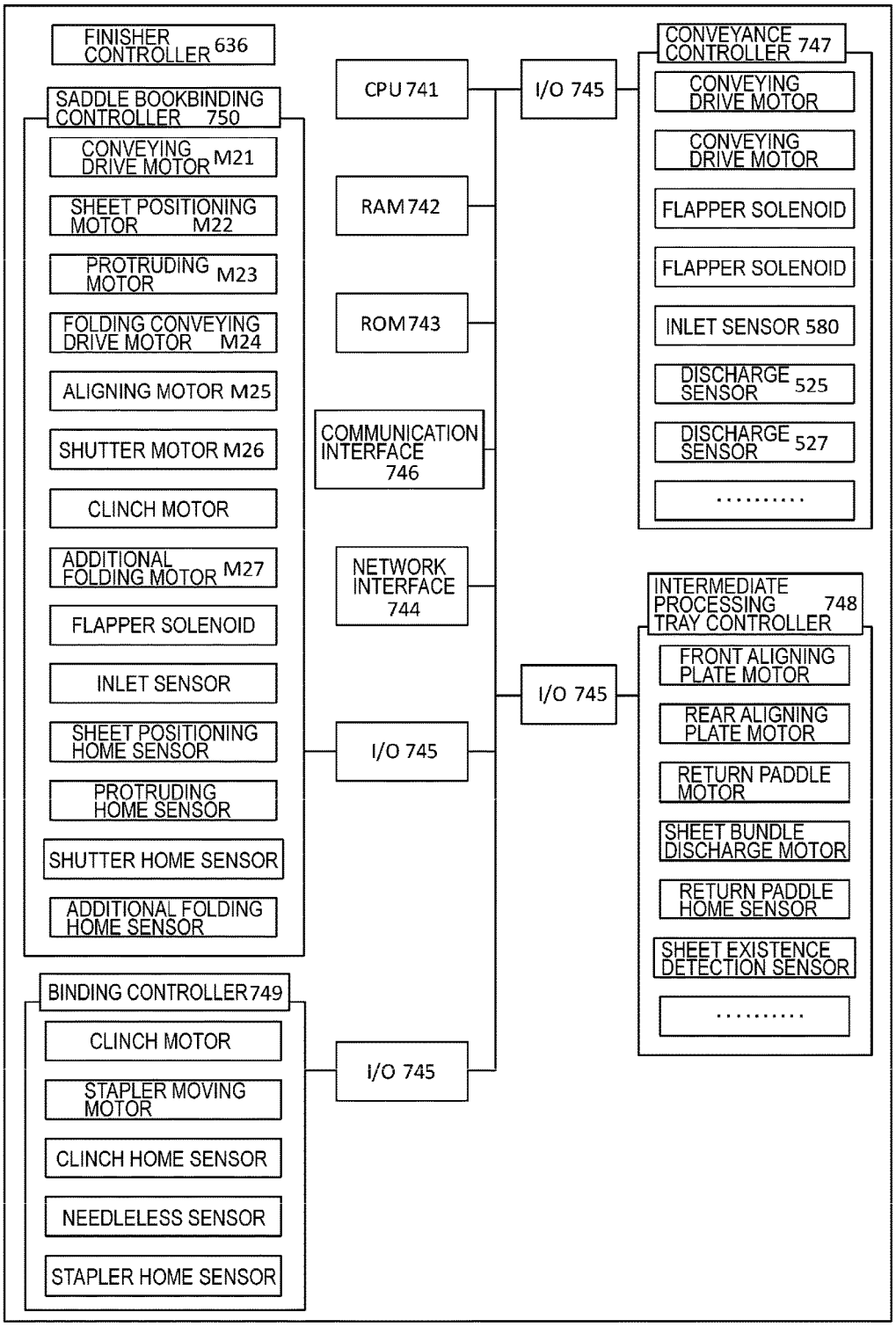
FIG. 11 is a block diagram of the finisher.

The pair of folding rollers 810, the pair of first folding conveying rollers 811, and the pair of second folding conveying rollers 812 rotate at the same speed by the same motor M24 (see FIG. 11).

When the sheet bundle bound by the stapler 820 is folded, after the stapling process is finished, the sheet positioning member 805 is lowered by a predetermined distance from the position at the time of the staple process so that the staple position of the sheet bundle comes to the nip position of the pair of folding rollers 810. Thus, it is possible to fold the sheet bundle with the position where the staple process is performed as the center.

A pair of aligning plates 815 has a surface which encircles the outer circumferential surface of the pair of folding rollers 810*a* and 810*b* and projects to the storage guide 803 and, and aligns the sheets stored in the storage guide 803. The pair of aligning plates 815 moves by driving a motor M25 (see FIG. 11) in the nip direction with respect to the sheets, and thereby positions the sheets in the width direction.

Figure 10:
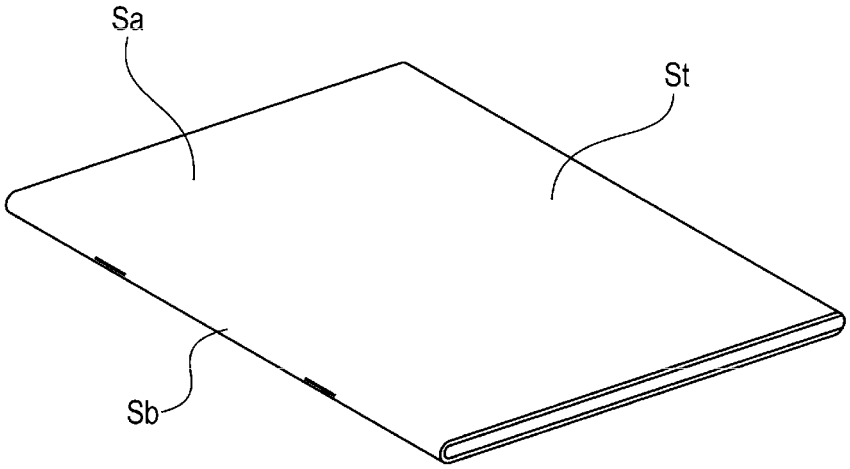
FIG. 10 is a perspective view showing a bundle-folded booklet.

As shown in FIG. 10, the saddle bookbinding portion 800 having the above configuration performs the saddle binding process to the center part of the sheets in the sheet conveying direction, and creates a booklet St which is a sheet bundle folded in half at the saddle-binding position.

Figure 13:
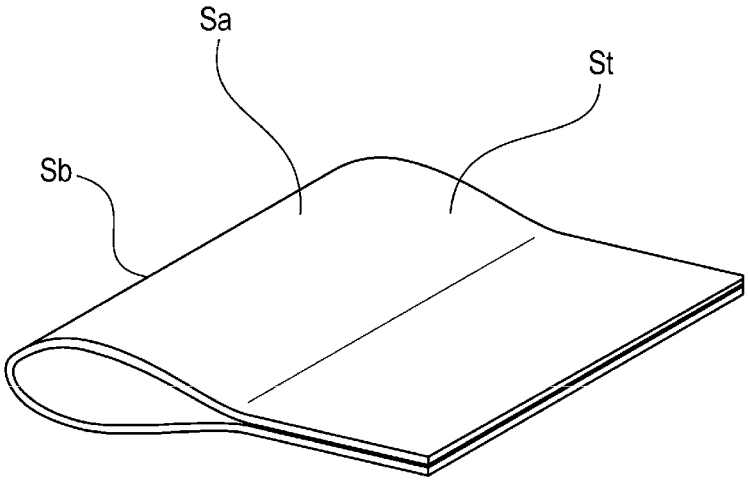
FIG. 13 is a perspective view showing a bundle-folded booklet.

When the sheet bundle is thick and the folding is not enough, the created booklet St is to be a booklet in which a folded part Sa bulges as shown in FIG. 13. On the contrary, when the sheet bundle is thin and folded firmly, a crack can occur at a folded part (spine) Sb of the created booklet. Especially, when the sheet used for a cover is thick paper, the crack is noticeable. In order to reduce the crack, the scoring unit 220 may perform scoring to score the folded part.

Next, the additional folding portion will be described. The additional folding portion 814 is provided at the downstream side in the sheet conveying direction of the pair of folding rollers 810*a* and 810*b* and the protruding member 830 constituting the folding portion, and is a folded-part processing unit which performs a process of pressing the folded part of the sheet bundle folded in half. In this embodiment, the additional folding portion 814 is incorporated in the finisher 100 as a part of the saddle bookbinding portion 800, but may be a separate unit disposed at the downstream side of the saddle stitch binding portion.

Figure 12:
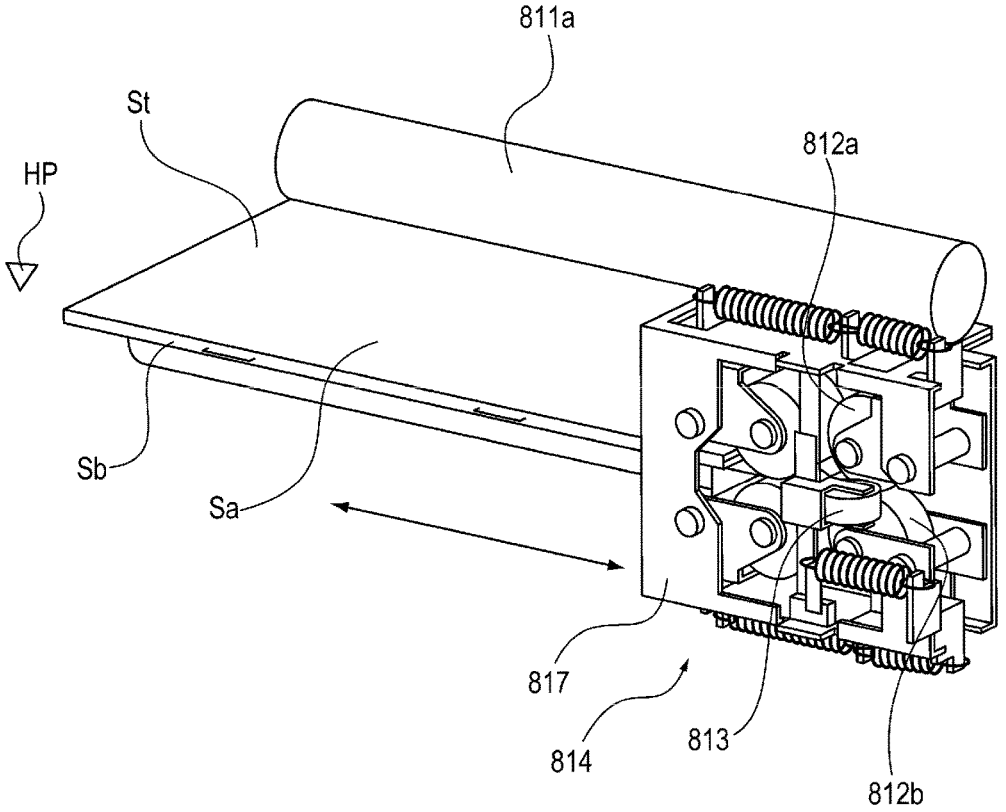
FIG. 12 is a perspective view showing an additional folding portion.
Figure 14:
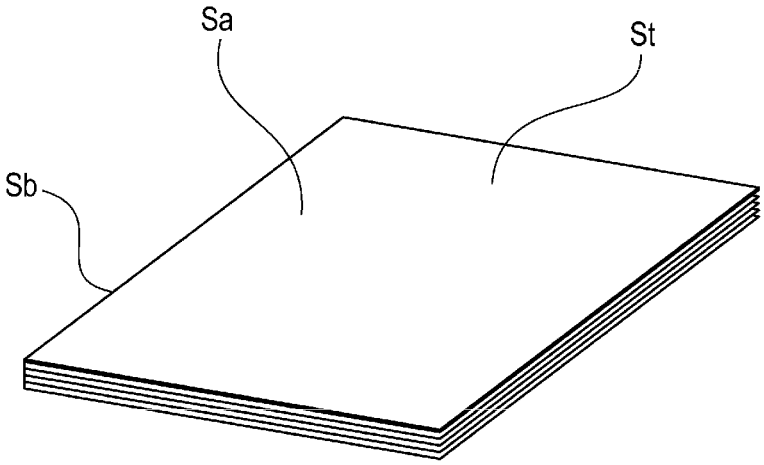
FIG. 14 is a perspective view showing a bundle-folded booklet.

FIG. 12 is a perspective view of the additional folding portion (folded-part processing unit) 814. The pair of second folding conveying rollers (pair of pressure rollers) 812*a* and 812*b* which holds the booklet St from the thickness direction of the booklet and presses it, and a spine crushing roller 813 which flattens the spine of the booklet from a direction orthogonal to the thickness of the booklet are incorporated in a frame 817. The frame 817 is movably supported by a guide portion (not shown) which guides the booklet so as to be movable in parallel to the spine of the booklet, and is driven by a drive unit (not shown). By flattening the folded part of the booklet by the spine crushing roller 813 while the pair of second folding conveying rollers (pair of pressure rollers) 812*a* and 812*b* presses the folded part of the booklet according to the movement of the additional folding portion 814, it is possible to create a booklet having a flat spine which does not bulge as shown in FIG. 14.

As shown in FIG. 11, the finisher controlling portion has a microcomputer (CPU) 741, a RAM 742, a ROM 743, an input/output portion (I/O) 745, a communication interface 746, and a network interface 744. A conveyance controlling portion 747 performs a conveyance process. In an intermediate processing tray controlling portion 748, the operation control of the front/back aligning plates of the processing tray 550, the rotation operation control of the return paddle, and the rotation operation control of the bundle discharge roller are controlled by a home position detecting sensor and a drive motor. In a binding controlling portion 749, clinching, movement, and the like of the stapler are controlled by the home position detecting sensor and the movement motor. In a saddle bookbinding controlling portion 750, the operation control of the aligning plate, the rotation operation control of the folding and conveying roller, the operation control of the protruding member, the sheet positioning operation control, the clinching operation control of the stapler, the operation control of the additional folding portion, and the like are controlled by the home position detecting sensor and the movement motor. Various sensor signals are input to the input port of the I/O 745. The output port of the I/O 745 is connected to drive systems connected through a control block (not shown) or various drivers (not shown).

<Determination Table for Scoring and Additional Folding Processes>

FIG. 15 is a determination table for the scoring process and the additional folding process. The CPU circuit portion 630 (the controller) compares the information on the sheet bundle (booklet) input to the operation portion 601 (the basis weight of the outermost sheet, the basis weight of the inner sheet, and the number of inner sheets) with the determination table, and performs the scoring process and the additional folding process. In this example, the basis weight of the outermost sheet, the basis weight of the inner sheet, and the number of inner sheets are exemplified as information on the sheet bundle constituting a booklet the information of which is to be input to the operation portion 601. Here, the outermost sheet is an outermost sheet of the sheet bundle constituting the booklet. In addition, the inner sheets are sheets other than the outermost sheet of the sheet bundle constituting the booklet.

As shown in FIG. 15, when the basis weight of the outermost sheet of the sheet bundle constituting the booklet is less than a predetermined basis weight, it is determined that scoring is not necessary, and the scoring is not performed to the sheets constituting the sheet bundle. Here, the predetermined basis weight of the outermost sheet is 157 gsm. However, the predetermined basis weight of the outermost sheet is only required to be appropriately set, and is not limited to the above basis weight. When the basis weight of the outermost sheet of the sheet bundle constituting the booklet is less than the predetermined basis weight, and when the number of sheets of the sheet bundle constituting the booklet is less than a predetermined number, it is determined that additional folding is not necessary, and the additional folding is not performed to the booklet. Here, the predetermined number of sheets of the sheet bundle is the case where the number of inner sheets is two. On the other hand, when the basis weight of the outermost sheet of the sheet bundle constituting the booklet is less than the predetermined basis weight, and when the number of sheets of the sheet bundle constituting the booklet is equal to or more than the predetermined number, it is determined that additional folding is necessary, and the additional folding is performed to the booklet.

As shown in FIG. 15, when the basis weight of the outermost sheet of the sheet bundle constituting the booklet is equal to or more than the predetermined basis weight, it is determined that the scoring is necessary and the scoring is performed to the sheets constituting the sheet bundle. When the basis weight of the outermost sheet of the sheet bundle constituting the booklet is equal to or more than the predetermined basis weight, and when the number of sheets of the sheet bundle constituting the booklet is less than the predetermined number of sheets, it is determined that the scoring is necessary and that the additional folding is not necessary. Thus, the scoring is performed to the sheets constituting the sheet bundle, and the additional folding is not performed to the half-folded sheet bundle constituting the booklet.

On the other hand, when the number of sheets of the sheet bundle constituting the booklet is equal to or more than the predetermined number, but when the basis weight of the outermost sheet of the sheet bundle constituting the booklet is equal to or more than the predetermined basis weight, it is determined that the scoring is necessary and that the additional folding is not necessary. Thus, the scoring is performed to the sheets constituting the sheet bundle, but the additional folding is not performed to the half-folded sheet bundle constituting the booklet. Here, if both the scoring and the additional folding are performed, since the spine of the booklet is squared by the additional folding, the spine of the booklet has a score and a bad appearance. For this reason, the scoring is performed and the additional folding is not performed.

Furthermore, when the basis weight of the outermost sheet of the sheet bundle constituting the booklet is equal to or more than the predetermined basis weight and when the number of sheets of the sheet bundle constituting the booklet is equal to or more than the predetermined number, but when the number of sheets exceeds the preset number of sheets, it is determined that the scoring is not necessary and that the additional folding is necessary. Here, the preset number of sheets is the case where the number of inner sheets is ten. In this case, the scoring is not performed to the sheets constituting the sheet bundle, but the additional folding is performed to the half-folded sheet bundle constituting the booklet.

That is, in the determination table shown in FIG. 15, a booklet in which the sheet bundle is thick and the folded part of the booklet bulges is to be subjected to the additional folding process. A booklet in which the sheet bundle is thin, the folded part of the booklet does not bulge, and thick paper which easily cracks is used as the outermost sheet is to be subjected to the scoring process. A booklet in which the sheet bundle is thin, the folded part of the booklet does not bulge, and thick paper which easily cracks is not used as the outermost sheet is not to be subjected to both processes. When the sheet bundle is thick although thick paper which easily cracks is used as the outermost sheet, the booklet is not folded firmly and bulges, and the outermost sheet cannot be folded firmly. For this reason, a crack reduction effect cannot be obtained although the outermost sheet is scored, and the booklet is to have a score. Thus, the additional folding process is performed without the scoring process.

By determining whether the scoring processing and the additional folding processing are necessary according to the information on the sheet bundle and performing the processes as described above, it is possible for the sheet processing apparatus to create a booklet under appropriate book creating conditions according to the booklet to be created.

In the above embodiment, the embodiment, in which it is determined whether the scoring is necessary according to whether the basis weight of the outermost sheet of the sheet bundle is equal to or more than the predetermined basis weight, has been exemplified. However, regardless of the basis weight of the outermost sheet of the sheet bundle, the necessity of the scoring may be determined simply according to the number of sheets of the sheet bundle. In this case, for example, the scoring is performed when the number of sheets of the sheet bundle is less than the predetermined number of sheets, and the scoring is not performed when the number of sheets of the sheet bundle is equal to or more than the predetermined number of sheets. Since a crack can occur on the spine when the number of sheets of the sheet bundle is small, the scoring is performed to handle this. When the number of sheets of the sheet bundle is large (that is, the sheet bundle is thick), although the spine of the sheets bulges and cracks do not occur, the score can be noticeable, and the scoring is not performed to handle this.

<Necessity Determination of Scoring and Additional Folding Processes>

FIG. 16 is a table showing arithmetic expressions for determining necessity of the scoring process and the additional folding process to computing conditions as to whether thick paper is used as the outermost sheet and as to whether the thickness of the sheet bundle exceeds a specified value, instead of the determination table of FIG. 15. The CPU circuit portion 630 (the controller) performs the computation based on the information on the sheet bundle (booklet) input to the operation portion 601 (the basis weight of the outermost sheet, the basis weight of the inner sheet, and the number of the inner sheets), and determines whether the scoring process and the additional folding process are necessary. Here, the information on the sheet bundle, the outermost sheet, and the inner sheet are as described above.

In FIG. 16, when the basis weight of the outermost sheet of the sheet bundle constituting the booklet is less than a predetermined basis weight, it is determined that scoring is not necessary, and the scoring is not performed to the sheets constituting the sheet bundle. Here, the predetermined basis weight of the outermost sheet is 157 gsm. On the other hand, when the basis weight of the outermost sheet of the sheet bundle constituting the booklet is equal to or more than the predetermined basis weight, it is determined that the scoring is necessary and the scoring is performed to the sheets constituting the sheet bundle.

Further, when the thickness of the sheet bundle constituting the booklet is less than a predetermined thickness, it is determined that the additional folding is not necessary, and the additional folding is not performed to the half-folded sheet bundle constituting the booklet. Here, the predetermined thickness of the sheet bundle is 1050 gsm. On the other hand, when the thickness of the sheet bundle constituting the booklet is equal to or more than the predetermined thickness, it is determined that the additional folding is necessary, and the additional folding is performed to the half-folded sheet bundle constituting the booklet.

When the basis weight of the outermost sheet of the sheet bundle constituting the booklet is equal to or more than the predetermined basis weight, but when the thickness of the sheet bundle constituting the booklet is equal to or more than the predetermined thickness, it is determined that the scoring is not necessary, and the scoring is not performed to the sheets constituting the sheet bundle.

That is, in FIG. 16, when the outermost sheet is 157 gsm or more, and when the thickness of the sheet bundle is less than 1050 gsm, it is determined that the folded part of the booklet easily cracks, and the scoring process is performed. When the outermost sheet is less than 157 gsm, and when the thickness of the sheet bundle is 1050 gsm or more, it is determined that the booklet easily bulge, and the additional folding process is performed. When the outermost sheet is less than 157 gsm, and when the thickness of the sheet bundle is less than 1050 gsm, it is determined that cracks does not occur at the folded part and that the booklet does not bulge, and both processes are not performed. When the outermost sheet of 157 gsm or more is used, but when the sheet bundle is 1050 gsm or more, the booklet is not folded firmly and bulges, and thus the outermost sheet is not folded firmly. For this reason, a crack reduction effect cannot be obtained although the outermost sheet is scored, and the booklet is to have a score. Thus, the scoring process is not performed.

By determining whether the scoring processing and the additional folding processing are necessary according to the information on the sheet bundle and performing the processes as described above, it is also possible for the sheet processing apparatus to create a booklet under appropriate book creating conditions according to the booklet to be created.

<Description of Bookbinding Mode Operation>

Figure 17:
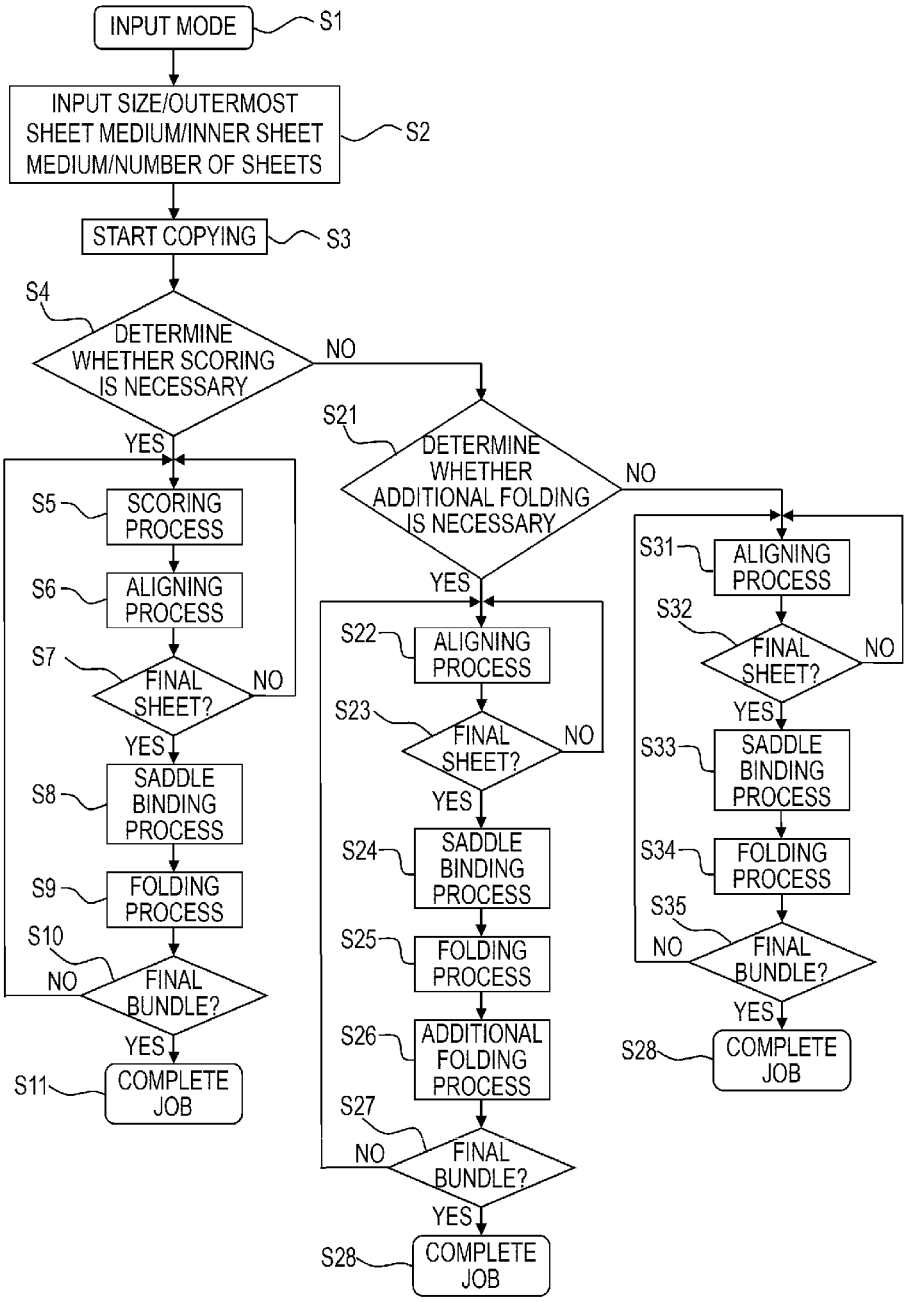
FIG. 17 is a flowchart showing operation in a bookbinding mode.

The operation in a bookbinding mode will be described with reference to the flowchart of FIG. 17. FIG. 17 is a flowchart showing an operation procedure of the bookbinding mode in which a sheet bundle including a plurality of sheets is saddle-bound and folded in half and a booklet is created. The operation showed in FIG. 17 is performed by the CPU 629 executing the program stored in the ROM 631.

The bookbinding mode is selected through the operation portion 601 (STEP 1), the size of the sheet, the basis weight of the outermost sheet, the basis weight of the inner sheet, and the number of the inner sheets are selected (STEP 2), and copying is started (STEP 3) to start print. According to the determination table for the scoring and the additional folding processes shown in FIG. 15, it is determined whether the scoring and the additional folding are necessary (STEPS 4 and 21). When it is determined that the scoring is necessary in STEP 4, the scoring apparatus 200 performs the scoring process to the sheets (the outermost sheet and the cover sheet) (STEP 5). Thereafter, the sheets are conveyed to the saddle bookbinding portion 800. The sheets are stored in the storage portion and subjected to the aligning process (STEP 6). When the final sheet is stored and aligned (STEP 7), the saddle binding process (STEP 8) and the folding process (STEP 9) are performed, and a booklet scored at the folded part is created. When a sheet bundle is the final bundle (STEP 10), the job is completed (STEP 11).

When it is determined that the scoring is not necessary in STEP 4 and that the additional folding is necessary in STEP 21, the scoring apparatus 200 does not perform the scoring process and the sheets are conveyed to the saddle bookbinding portion 800. The sheets are stored in the storage portion and subjected to the aligning process (STEP 22). When the final sheet is stored and aligned (STEP 23), the saddle binding process (STEP 24) and the folding process (STEP 25) are performed. Furthermore, the additional folding portion 814 performs the additional folding process (STEP 26), and a booklet having a flattened spine is created. When a sheet bundle is the final bundle (STEP 27), the job is completed (STEP 28).

When it is determined that the scoring is not necessary in STEP 4 and that the additional folding is not necessary in STEP 21, the scoring apparatus 200 does not perform the scoring process and the sheets are conveyed to the saddle bookbinding portion 800. The sheets are stored in the storage portion and subjected to the aligning process (STEP 31). When the final sheet is stored and aligned (STEP 32), the saddle binding process (STEP 33) and the folding process (STEP 34) are performed, and a booklet in which the scoring is not performed and a spine is not flattened. When a sheet bundle is the final bundle (STEP 35), the job is completed (STEP 36).

As described above, according to the present embodiment, by automatically performing processes necessary for the booklet according to the conditions of the booklet to be created, it is possible to save time and labor for an operator to make a sample to check necessary processes.

Note that, in STEPS 4 and 21, the determination table for the scoring and additional folding processes shown in FIG. 15 can be replaced with the necessity determination of the scoring and additional folding processes using the arithmetic expressions shown in FIG. 16.

In the above embodiment described with reference to FIG. 16, the embodiment, in which it is determined whether the scoring is necessary according to whether the basis weight of the outermost sheet of the sheet bundle is equal to or more than the predetermined basis weight, has been exemplified. However, regardless of the basis weight of the outermost sheet of the sheet bundle, the necessity of scoring may be determined according to the thickness of the sheet bundle calculated from the basis weight of the sheet and the number of sheets. In this case, for example, the scoring is performed when the thickness of the sheet bundle is less than the predetermined thickness, and the scoring is not performed when the thickness the sheet bundle is equal to or more than the predetermined thickness.

In any of the embodiments described above, the sheet processing apparatus including the additional folding portion 814 has been exemplified. Needless to say, the present invention can be also applied to a sheet processing apparatus which does not include the additional folding portion 814. Although the embodiment in which the scoring apparatus 200 performs scoring to sheets (an outermost sheet and sheets other than the outermost sheet) constituting a sheet bundle (booklet) has been exemplified, the scoring may be performed only to the outermost sheet of the sheets constituting a sheet bundle (booklet).

In the above embodiments, a copying machine has been exemplified as the image forming apparatus, but the present invention is not limited thereto, and may be other image forming apparatuses such as a printer, a facsimile apparatus, and the like, or a complex machine and the like in which these functions are combined. Similar effects can be obtained by applying the present invention to a sheet processing apparatus connected to these image forming apparatuses or a sheet processing apparatus provided in these image forming apparatuses.

Furthermore, in the above embodiments, the sheet processing apparatus connected to the apparatus main body of the image forming apparatus has been exemplified, but the present invention is not limited thereto. For example, a sheet processing apparatus may be included integrally in an image forming apparatus, and similar effects can be obtained by applying the present invention to the sheet processing apparatus. Moreover, although the sheet processing apparatus including the scoring apparatus having the scoring unit separately from the finisher having the additional folding portion has been exemplified, the present invention is not limited thereto. A sheet processing apparatus may integrally include the scoring unit and the additional folding portion, and similar effects can be obtained by applying the present invention to the sheet processing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138215, filed Jul. 13, 2016, which is hereby incorporated by reference herein in its entirety.

What is claimed is:

1. A sheet processing apparatus comprising:

a scoring unit configured to score a sheet;

a folding unit configured to fold a sheet bundle including a plurality of sheets;

a pressing unit configured to flatten a spine of the sheet bundle folded by the folding unit by pressing the spine from a downstream side of a conveying direction in a direction opposite to the conveying direction, the conveying direction being a direction in which the sheet bundle is conveyed; and a controller configured to prohibit scoring of the sheet by the scoring unit in a case where the spine is flattened by the pressing unit.

2. The sheet processing apparatus according to claim 1, wherein the pressing unit is configured to flatten the spine in a case where the number of sheets included in the sheet bundle is more than a first predetermined number of sheets, and wherein the controller is configured to prohibit the scoring unit from scoring the sheet in a case where the number of sheets included in the sheet bundle is more than the first predetermined number of sheets.

3. The sheet processing apparatus according to claim 2, wherein the controller is configured to prohibit the scoring unit from scoring the sheet and to control the pressing unit to flatten the spine, in a case where a basis weight of an outermost sheet of the sheet bundle is larger than a predetermined basis weight and the number of sheets included in the sheet bundle is more than the first predetermined number of sheets.

4. The sheet processing apparatus according to claim 3, wherein the controller is configured to prohibit the pressing unit from flattening the spine and to control the scoring unit to score the outermost sheet, in a case where the basis weight of the outermost sheet is larger than the predetermined basis weight and the number of sheets included in the sheet bundle is less than the first predetermined number of sheets and is more than a second predetermined number of sheets which is less than the first predetermined number of sheets.

5. The sheet processing apparatus according to claim 1, wherein the controller is configured to control the scoring unit to score an outermost sheet of the sheet bundle and to prohibit the pressing unit from flattening the spine in a case where a thickness of the sheet bundle is less than a predetermined thickness, and wherein the controller is configured to prohibit the scoring unit from scoring the sheet and to control the pressing unit to flatten the spine in a case where the thickness of the sheet bundle is more than the predetermined thickness.

6. The sheet processing apparatus according to claim 1 further comprising an acquiring unit configured to acquire information indicating the number of sheets included in the sheet bundle.

7. The sheet processing apparatus according to claim 1, wherein the pressing unit flattens the spine while moving along a direction intersecting the conveying direction.

8. The sheet processing apparatus according to claim 1, wherein the controller controls so that the pressing unit does not flatten the spine of the sheet bundle including the sheet which has been scored by the scoring unit.

9. A sheet processing apparatus comprising:

a scoring unit configured to score a sheet;

a folding unit configured to fold a sheet bundle including a plurality of sheets;

a pressing unit configured to flatten a spine of the sheet bundle folded by the folding unit by pressing the spine from a downstream side of a conveying direction in a direction opposite to the conveying direction, the conveying direction being a direction in which the sheet bundle is conveyed; and a controller configured to prohibit the pressing unit from flattening the spine in a case where the sheet is scored by the scoring unit.

10. The sheet processing apparatus according to claim 9, wherein the scoring unit is configured to score the sheet in a case where a basis weight of an outermost sheet of the sheet bundle is more than a predetermined basis weight, and wherein the controller is configured to prohibit the pressing unit from flattening the spine in a case where the basis weight of the outermost sheet is more than the predetermined basis weight and the number of sheets included in the sheet bundle is less than a first predetermined number of sheets and is more than a second predetermined number of sheets which is less than the first predetermined number of sheets.

11. The sheet processing apparatus according to claim 9, wherein the controller is configured to control the scoring unit to score an outermost sheet of the sheet bundle and to prohibit the pressing unit from flattening the spine in a case where a thickness of the sheet bundle is less than a predetermined thickness, and wherein the controller is configured to prohibit the scoring unit from scoring the sheet and to control the pressing unit to flatten the spine in a case where the thickness of the sheet bundle is more than the predetermined thickness.

12. The sheet processing apparatus according to claim 9, wherein the pressing unit flattens the spine while moving along a direction intersecting the conveying direction.

13. The sheet processing apparatus according to claim 9, wherein the controller controls so that the pressing unit does not flatten the spine of the sheet bundle including the sheet which has been scored by the scoring unit.

* * * * *